US011053448B2

(12) United States Patent
Rämö et al.

(10) Patent No.: US 11,053,448 B2
(45) Date of Patent: Jul. 6, 2021

(54) HYDRAULIC FLUID COMPOSITION

(71) Applicant: Neste Corporation, Espoo (FI)

(72) Inventors: Virpi Rämö, Porvoo (FI); Ari Saastamoinen, Porvoo (FI); Heinz Schwab, Frankfurt (DE)

(73) Assignee: NESTE OYJ, Espoo (FI)

( * ) Notice: Subject to any disclaimer, the term of this patent is extended or adjusted under 35 U.S.C. 154(b) by 0 days.

(21) Appl. No.: 16/473,099

(22) PCT Filed: Dec. 21, 2017

(86) PCT No.: PCT/FI2017/050923
§ 371 (c)(1),
(2) Date: Jun. 24, 2019

(87) PCT Pub. No.: WO2018/115589
PCT Pub. Date: Jun. 28, 2018

(65) Prior Publication Data

US 2019/0345404 A1 Nov. 14, 2019

(30) Foreign Application Priority Data

Dec. 22, 2016 (FI) ..... 20166022

(51) Int. Cl.

| | |
|---|---|
| ***C10M 101/02*** | (2006.01) |
| *C10N 20/00* | (2006.01) |
| *C10N 30/02* | (2006.01) |
| *C10N 40/08* | (2006.01) |
| *C10N 40/04* | (2006.01) |

(52) U.S. Cl.
CPC .. *C10M 101/02* (2013.01); *C10M 2203/1025* (2013.01); *C10M 2203/1065* (2013.01); *C10N 2020/071* (2020.05); *C10N 2030/02* (2013.01); *C10N 2040/042* (2020.05); *C10N 2040/08* (2013.01)

(58) Field of Classification Search
None
See application file for complete search history.

(56) References Cited

U.S. PATENT DOCUMENTS

| | | | |
|---|---|---|---|
| 4,078,010 | A | 3/1978 | Prillieux et al. |
| 2004/0014616 | A1 | 1/2004 | Genuyt et al. |
| 2007/0135663 | A1 | 6/2007 | Aalto et al. |
| 2007/0208205 | A1* | 9/2007 | Baba ..... C10M 169/04 585/6.3 |
| 2007/0259792 | A1 | 11/2007 | Nul |
| 2011/0290702 | A1 | 12/2011 | Germaine et al. |
| 2012/0010109 | A1 | 1/2012 | Westelynck et al. |
| 2012/0077923 | A1 | 3/2012 | Tredget |
| 2014/0144197 | A1* | 5/2014 | Tanino ..... B21H 3/02 72/42 |
| 2016/0122612 | A1 | 5/2016 | Van Slyke et al. |
| 2019/0024004 | A1* | 1/2019 | Kuroda ..... C10M 177/00 |
| 2019/0284498 | A1* | 9/2019 | Sakanoue ..... C10M 169/041 |
| 2020/0199474 | A1* | 6/2020 | Hill, Jr. ..... H01B 3/22 |

FOREIGN PATENT DOCUMENTS

| | | | |
|---|---|---|---|
| EP | 2039745 | B1 | 6/2013 |
| FR | 2501224 | A1 | 9/1982 |
| RU | 2373265 | C1 | 11/2009 |
| RU | 2430146 | C2 | 9/2011 |
| RU | 2477308 | C1 | 3/2013 |
| RU | 2494140 | C2 | 9/2013 |
| RU | 2548912 | C2 | 4/2015 |
| WO | 2007144473 | A1 | 12/2007 |
| WO | 2009021958 | A2 | 2/2009 |
| WO | 2010086507 | A1 | 8/2010 |
| WO | 2010125144 | A1 | 11/2010 |
| WO | 2015101837 | A2 | 7/2015 |
| WO | 2015192072 | A1 | 12/2015 |

OTHER PUBLICATIONS

International Search Report and Written Opinion issued in corresponding International Patent Application No. PCT/FI2017/050923, 12 pages (dated Mar. 5, 2018).
Search Report issued in corresponding Finnish Patent Application No. 20166022, 2 pages (dated Jul. 19, 2017).
Office Action dated Jan. 28, 2020, by the Indian Patent Office in corresponding Indian Patent Application No. 201917024429. (5 pages).
Russian Office Action dated Feb. 14, 2020, by the Russian Patent Office in corresponding Russian Patent Application No. 2019122453 and an English Translation of the Office Action. (18 pages).
Office Action dated Sep. 8, 2020, by the Canadian Patent Office in corresponding Canadian Patent Application No. 3,047,674. (6 pages).

* cited by examiner

*Primary Examiner* — Tam M Nguyen
(74) *Attorney, Agent, or Firm* — Buchanan Ingersoll & Rooney PC

(57) ABSTRACT

The invention provides a hydraulic fluid composition comprising a hydrocarbon component comprising more than 5 wt % of naphthenic oil and up to 95 wt % of renewable or recycled isoparaffinic oil, based on the total weight of the composition. The hydraulic fluid composition is useful as an arctic hydraulic fluid composition, shock absorber or automatic transmission fluid.

19 Claims, No Drawings

HYDRAULIC FLUID COMPOSITION

FIELD OF THE INVENTION

The present invention relates to a hydraulic fluid composition comprising naphthenic oil and renewable or recycled isoparaffinic oil. The hydraulic fluid composition is useful as a shock absorber fluid, arctic hydraulic fluid or automatic transmissions fluid, for example.

BACKGROUND OF THE INVENTION

US 2007/0259792 A1 discloses a fluid composition comprising 70-99.99% by weight, based on the total hydraulic fluid composition, of a readily bio-degradable base oil composition comprising (i) from 80 to 100% by weight of a base oil or base stock having a paraffin content of greater than 80% by weight paraffins and a saturates content of greater than 98% by weight and comprising a series of iso-paraffins having n, n+1, n+2, n+3 and n+4 carbon atoms and wherein n is between 15 and 35, and having a kinematic viscosity at 100° C., of at most 5.5 $mm^2$/sec; and (ii) of from 0 to 20% by weight of an ester of a polyhydroxy compound, calculated on the base oil composition; and (b) a viscosity index improver in an amount of from 0.01 to 30% by weight, based on the total hydraulic fluid composition, wherein the hydraulic fluid composition has a viscosity index in the range of from 50 to 1000, and a pour point of −30° C., or below.

Naphthenic oils are commonly used as hydraulic oils. They have good solubilizing ability for polar additives and polar oxygenates that may form in the oils during the use of the hydraulic system. Moreover, naphthenic oils have relatively low volatility.

Low viscosity mineral oils, such as mineral group III 3 cSt base oils, are also functional as shock absorber fluids. These fluids dissipate the kinetic energy developed in a shock by transforming it to other forms of energy, such as heat. Further, low viscosity mineral oils are utilized as automotive transmission fluids.

There is a need for fluids with high compatibility with viscosity index improvers at low temperatures. Further, there is a need for low viscosity hydraulic fluid compositions which have low viscosity at low temperatures for use in arctic applications.

BRIEF DESCRIPTION OF THE INVENTION

The present invention provides a hydraulic fluid composition comprising a naphthenic oil (NBO) component and an isoparaffinic oil (IPO) component.

The viscosity index, pour point and flash point of the hydrocarbon component included in the hydraulic fluid composition of the invention are suitable for shock absorber fluids, arctic hydraulic fluids or automatic transmissions fluids. Arctic hydraulic fluids are applied in systems that are used discontinuously and cold started at low temperatures, for example in outdoor systems, such as marine hydraulics and garbage truck hydraulics, where the fluids are employed without pre-heat treatment.

The invention also provides a hydraulic system comprising the hydraulic fluid composition of the invention.

It was surprisingly found that the viscosity of a hydraulic fluid composition was substantially decreased at low temperatures by incorporating isoparaffinic oil to naphthenic oil, compared with a hydraulic fluid including solely naphthenic oil as an oil component. Specifically, when the fluid of the invention is used as a hydraulic fluid in hydraulic systems, the low viscosity of the hydraulic fluid at low temperatures of below −30° C. significantly facilitates the cold starting of the hydraulic systems. Moreover, lower energy is advantageously needed to build up necessary pressure at the cold start and also during the operation.

DETAILED DESCRIPTION OF THE INVENTION

An object of the invention is to provide a hydraulic fluid composition comprising a hydrocarbon component comprising more than 5 wt % of naphthenic oil and up to 95 wt % of renewable or recycled isoparaffinic oil, based on the total weight of the composition.

The hydraulic fluid composition is useful as, but is not limited to, an arctic hydraulic fluid composition, shock absorber or automatic transmission fluid.

In the present invention, the term 'naphthenic oil' (abbreviated as NBO) means an oil that contains a substantial amount of cyclic saturated hydrocarbon compounds, i.e. naphthenes;

the term 'renewable or recycled isoparaffinic oil' (abbreviated as IPO) means an oil containing a substantial amount of isoparaffinic compounds prepared by hydrotreating and isomerizing an oil derived from renewable or recycled raw materials. The hydrotreatment and isomerization of the oil can be carried out as described, e.g., in FI 100248. The renewable or recycled raw materials can be originated from plants or animals, such as vegetable oils, animal fats, fish oils and mixtures thereof. Examples of suitable renewable and recycled raw materials include, but are not limited to, rapeseed oil, canola oil, colza oil, tall oil, sunflower oil, soybean oil, hemp oil, olive oil, linseed oil, mustard oil, palm oil, arachis oil, castor oil, coconut oil, animal fats, such as suet, tallow, blubber. The renewable or recycled raw materials can also be produced by microbes such as algae and bacteria. Further, the renewable or recycled raw materials encompass condensation products, such as esters, and other derivates of the renewable or recycled raw materials.

In an embodiment, the hydrocarbon component consists of the iso-paraffinic oil and the naphthenic oil.

In an embodiment, the amount of the naphthenic oil is less than 80% wt %, specifically less than 70 wt %, based on the total weight of the composition.

In an embodiment, the hydraulic fluid composition of the invention comprises from about 20 wt % to about 30 wt % of the renewable or recycled isoparaffinic oil, based on the total weight of the composition.

The isoparaffinic oil used in the present invention has a distillation range from 240° C. to 300° C. In an embodiment, the distillation range is from 267° C. to 288° C. In another embodiment, the distillation range is from 283° C. to 300° C. In a still further embodiment, the distillation range is from 265° C. to 290° C.

The pour point of the isoparaffinic oil with a distillation range from 267° C. to 288° C. is −69° C. measured according to ASTMD 5950. The isoparaffinic oil with a distillation range from 267° C. to 288° C. is free from volatile organic compounds (VOCs) determined according to DIN EN 13016-1.

The carbon chain distribution of the isoparaffinic oil depends on the raw material used for producing it. In an embodiment, the isoparaffinic oil with a distillation range from 267° C. to 288° C. has one or more of the following carbon chain distributions:

<C15 paraffins less than about 5 wt %,

C15 paraffins from about 5 wt % to about 15 wt % of which isoparaffins more than about 75 wt %, C16 paraffins from about 50 wt % to about 65 wt % of which isoparaffins more than about 90 wt %, C17 paraffins from about 20 wt % to about 30 wt % of which isoparaffins more than 90 wt %, C18 paraffins from about 5 wt % to about 15 wt % of which isoparaffins more than about 90 wt %, >C18 paraffins less than about 5 wt %.

In an embodiment, the isoparaffinic oil with a distillation range from 267° C. to 288° C. has the following carbon chain distributions:

<C15 paraffins 1.02 wt %,

C15 paraffins 7.86 wt % of which isoparaffins 79.81 wt %,

C16 paraffins 58.83 wt % of which isoparaffins 94.33 wt %,

C17 paraffins 23.82 wt % of which isoparaffins 97.03 wt %,

C18 paraffins 8.48 wt % of which isoparaffins 99.96 wt %,

>C18 paraffins 0.00 wt %.

The pour point of the isoparaffinic oil with a distillation range from 283° C. to 300° C. is −42° C. measured according to ASTMD 5950. The isoparaffinic oil with distillation range from 283° C. to 300° C. is free from volatile organic compounds (VOCs) determined according to DIN EN 13016-1.

In an embodiment, the isoparaffinic oil with a distillation range from 283° C. to 300° C. has one or more of the following carbon chain distributions:

<C16 paraffins less than about 5 wt %,

C16 paraffins from 0 wt % to about 10 wt % of which isoparaffins more than 80 wt %, C17 paraffins from about 5 wt % to about 20 wt % of which isoparaffins more than about 50 wt %, C18 paraffins from about 70 wt % to about 85 wt % of which isoparaffins more than 90 wt %, C19 paraffins from 0 wt % to about 10 wt % of which isoparaffins more than about 90 wt %, C20 paraffins from 0 wt % to about 10 wt % of which isoparaffins more than about 90 wt %, >C20 paraffins less than about 5 wt %.

In another embodiment, the isoparaffinic oil with a distillation range from 283° C. to 300° C. has the following carbon chain distributions:

<C16 paraffins 0.18 wt %,

C16 paraffins 2.02 wt % of which isoparaffins 87.13 wt %,

C17 paraffins 12.44 wt % of which isoparaffins 58.41 wt %,

C18 paraffins 81.91 wt % of which isoparaffins 96.82 wt %,

C19 paraffins 1.30 wt % of which isoparaffins 97.35 wt %,

C20 paraffins 1.14 wt % of which isoparaffins 97.90 wt %,

>C20 paraffins 1.01 wt %.

In an embodiment, the hydraulic fluid composition of the invention comprises one or more viscosity index (VI) improvers. The amount of the VI improves(s) is in the range of 0.01-30 wt % of the total weight of the composition. In another embodiment, the amount of VI improver(s) is in the range of 10 wt % to 25 wt %. VI improver is used to increase the viscosity index of the fluid composition and to decrease the relative viscosity changes with the temperature. The VI improver further improves the usability of the low viscosity fluid composition of the invention at low temperatures, whereby cold starting of the hydraulic systems is facilitated. Suitable VI improves in the present invention encompass those conventionally used in the arctic hydraulic fluid compositions, shock absorbers and automatic transmission fluids and include, but are not limited to, low or high molecular weight polymers or copolymers of acrylates, butadiene, olefins or alkylated styrenes. Examples of the suitable VI improves are commercially available Viscoplex 7 series produced by Evonik.

In an embodiment, the fluid composition of the invention comprises one of more additives to provide protection against wear, foaming, corrosion and oxidation, for example. The amount of additives typically amounts up to 5 wt % of the total weight of the composition and are those conventionally used for specific application.

The kinematic viscosity of the hydraulic fluid composition of the invention was measured according to ENISO3104. The kinematic viscosity of the hydraulic fluid composition of the invention of ISO VG 15 cSt, i.e. an arctic hydraulic grade, is below 1000 cSt at −40° C.

The kinematic viscosity of the hydraulic fluid composition of the invention of ISO VG 28 cSt, i.e. an arctic hydraulic grade, is below 1000 cSt at −30° C.

The kinematic viscosity of the hydraulic fluid composition of the invention may be higher, e.g. about 5000 cSt, depending on the application in which the composition is used. The level of the kinematic viscosity depends on the amount and properties of the NBO, for example, used in the composition.

Viscosity index of the composition of the invention is in the range of 50-1000 measured according to ASTMD2270. In an embodiment, the viscosity index is in the range of 250-1000.

Flash point of the composition of the invention is above 100° C. measured according to ENISO2592 or ASTMD92.

Pour point of the composition of the invention is below −30° C. measured according to ASTMD5950.

Another aspect of the invention is to provide a hydraulic system comprising the hydraulic fluid composition of the invention. The hydraulic system includes, but is not limited to, marine hydraulics and garbage truck hydraulics.

The following examples are given for further illustration of the invention without limiting the invention thereto.

EXAMPLE 1

The kinematic viscosity of the hydrocarbon component of the hydraulic fluid compositions of the invention, containing isoparaffinic oil (IPO) and naphthenic oil (NBO) at various weight ratios was measured at various temperatures according to ENISO3104. The pour points of the mixtures were detected according to ASTMD5950 with 3° C. intervals. Pour point of the oil is considered as an index of the lowest temperature at which the oil can be used for the specific application. The NBO contained approximately 55 wt % naphthenes, 38 wt % paraffins and 7 wt % aromatics, and had a kinematic viscosity of 3.9 cSt at −40° C. This NBO was also used as a reference.

The test method ASTMD5950 for pour point covers the determination of pour point of petroleum products by an automatic instrument that tilts the test jar during cooling and detects movement of the surface on the specimen with an optical device. In the experiment, the temperature of the sample was lowered with 3° C. intervals until the point of no flow was verified by an optical detector. Low temperature pour points below −69° C. measured for the compositions are indicated as "<−70° C." in Table 1.

Hydraulic fluid compositions were prepared according to Table 1. IPO X is an isoparaffinic oil having a distillation range from 267° C. to 288° C. IPO Y is an isoparaffinic oil having a distillation range from 283° C. to 300° C.

The IPO X had the following carbon chain distribution:
<C15 paraffins 1.02 wt %,
C15 paraffins 7.86 wt % of which isoparaffins 79.81 wt %,
C16 paraffins 58.83 wt % of which isoparaffins 94.33 wt %,
C17 paraffins 23.82 wt % of which isoparaffins 97.03 wt %,
C18 paraffins 8.48 wt % of which isoparaffins 99.96 wt %,
>C18 paraffins 0.00 wt %.

The IPO Y had the following carbon chain distribution:
<C16 paraffins 0.18 wt %,
C16 paraffins 2.02 wt % of which isoparaffins 87.13 wt %,
C17 paraffins 12.44 wt % of which isoparaffins 58.41 wt %,
C18 paraffins 81.91 wt % of which isoparaffins 96.82 wt %,
C19 paraffins 1.30 wt % of which isoparaffins 97.35 wt %,
C20 paraffins 1.14 wt % of which isoparaffins 97.90 wt %,
>C20 paraffins 1.01 wt %.

TABLE 1

| Component | Ref | 1 | 2 | 3 | 4 | 5 | 6 | 7 | 8 | 9 | 10 |
|---|---|---|---|---|---|---|---|---|---|---|---|
| | Amount in the composition (wt %) | | | | | | | | | | |
| | Composition | | | | | | | | | | |
| IPO X | | 10 | 20 | 30 | 50 | 70 | 100 | | | | |
| IPO Y | | | | | | | | 20 | 30 | 50 | 100 |
| NBO | 100 | 90 | 80 | 70 | 50 | 30 | | 80 | 70 | 50 | |
| | Kinematic viscosity (mm2/s) at altering temperatures | | | | | | | | | | |
| 100° C. | 1 | 1 | 1 | 1 | 1 | 1 | 1 | 1 | 1 | 1 | 1 |
| 40° C. | 4 | 4 | 4 | 3 | 3 | 3 | 3 | 4 | 4 | 4 | 4 |
| −20° C. | 44 | 38 | 34 | 30 | 25 | 22 | 19 | 38 | 36 | 33 | 29 |
| −30° C. | 92 | 77 | 65 | 57 | 45 | 38 | 31 | 74 | 68 | 60 | 112 |
| −40° C. | 250 | 195 | 157 | 130 | 96 | 77 | 61 | 181 | 175 | 201 | n.d. |
| −50° C. | 913 | 630 | 464 | 360 | 385 | 389 | 312 | 736 | 1287 | n.d. | n.d. |
| | Pour point | | | | | | | | | | |
| PP (° C.) | <−70 | <−70 | <−70 | <−70 | <−70 | <−69 | <−69 | <−69 | <−70 | <−66 | <−42 |

n.d. = not detectible

At −40° C., IPO X (sample 6) had a kinematic viscosity which was 76% lower than that of the reference NBO (Ref) (61 $mm^2/s$ vs. 250 $mm^2/s$). At −50° C., the kinematic viscosity of sample 6 was 66% lower than that of Ref. The incorporation of IPO X to the NBO did not alter the viscosity linearly. For example, 30 wt % addition of IPO X (composition 3) decreased the viscosity at −40° C. from 250 $mm^2/s$ to 130 $mm^2/s$ which is 63% of the full potential, taking into account that the viscosity of IPO X is 61 $mm^2/s$ at −40° C. At −50° C., the viscosity decrease was 92% of the full potential (from 913 $mm^2/s$ to 360 $mm^2/s$) taking into account that the viscosity of IPO X is 312 $mm^2/s$ at −50° C. The results show that low temperature viscosity behavior of the mixtures of NBO and IPO is not linear.

The results further demonstrate that the pour point remains at a level acceptable in arctic hydraulic compositions. The viscosity remains at a low level up to the temperature of the pour point for the IPO X and IPO Y containing compositions whereas the viscosity starts to rapidly increase already at −50° C. for NBO (ref) having the pour point of <−70° C. Thus, the low temperature viscosity can be considered as a better indication for the cold operability of the arctic hydraulic fluid than the pour point.

There is a substantial improvement in the viscosity behavior of the mixtures containing IPO component (compositions 1-9) when compared to NBO (ref) up to −50° C. for the compositions containing IPO X, and up to −40° C. for the compositions containing IPO Y. This improvement in cold operability cannot be seen from the pour point results solely.

EXAMPLE 2

An arctic hydraulic fluid composition complying with ISO VG 15 grade was prepared by modifying the commercial "Neste Hydrauli Arctic 15" formulation. 20 wt % of the NBO component of Neste Hydrauli Arctic 15 was replaced by IPO X described in Example 1. The NBO of Neste Hydrauli Arctic 15 contained approximately 55 wt % naphthenes, 38 wt % paraffins and 7 wt % aromatics. The amount of VI improver was adjusted to 15 wt % to keep the ISO VG 15 grade. The same additives as those included in Neste Hydrauli Arctic 15 were added. The composition of the invention was as follows:

| | |
|---|---|
| NBO component of Neste Hydrauli Arctic 15 | 64 wt % |
| IPO X | 20 wt % |

-continued

| | |
|---|---|
| VI improver (Viscoplex 7-200) | 15 wt % |
| Additives | 1 wt % |

The kinematic viscosity of the composition of the present invention and that of the above commercial hydraulic fluid as a reference were measured according to ENISO3104 at various temperatures. The results are shown in Table 2.

TABLE 2

| | Temperature (° C.) | Neste Hydrauli Arctic 15 | Composition of the invention, ISO VG 15 |
|---|---|---|---|
| Kinematic viscosity ($mm^2/s$) | −50 | 7270 | 3898 |
| | −40 | 1759 | 818 |
| | −30 | 569 | 329 |
| | −20 | 245 | 163 |
| | −10 | 125 | 92 |
| | 0 | 72 | 57 |
| | 20 | 31 | 21 |
| | 40 | 17 | 16 |
| | 100 | 5 | 5 |

The results show that there was a 47% decrease in the viscosity at −40° C. when 20 wt % of isoparaffinic oil IPO X is introduced to the commercial arctic naphthenic fluid composition complying with ISO VG 15 grade. Thus, at −40° C. a viscosity level below 1000 $mm^2/s$ was achieved, which can be considered as an absolute viscosity reference value for good operability of a hydraulic system. This is considered a substantial improvement as regards the application of the hydraulic fluid composition for cold start of the hydraulic systems at low temperatures.

Table 3 presents the flash point, pour point and viscosity index of the composition of the invention. Flash point was at an acceptable level for an arctic hydraulic fluid. Pour point was slightly increased compared with the reference. However, as stated in example 1, the viscosity index is a better indication for a proper cold temperature operability than the pour point. The viscosity index of the composition of the invention was improved compared with the reference.

TABLE 3

| Property | Method | Neste Hydrauli Arctic 15 | Composition of the invention, ISO VG 15 |
|---|---|---|---|
| Flash point (° C.) | ENISO2592 | n.a. | 124 |
| Pour point (° C.) | ASTMD5950 | −66 | −57 |
| Viscosity index | ASTMD2270 | 293 | >300 |

n.a. = not analysed

EXAMPLE 3

An arctic hydraulic fluid composition complying with ISO VG 28 grade was prepared by modifying the commercial "Neste Hydrauli Arctic 28" formulation. 20 wt % of the NBO component of Neste Hydrauli Arctic 28 was replaced by IPO X described in Example 1. The NBO of Neste Hydrauli Arctic 28 contained approximately 55 wt % naphthenes, 38 wt % paraffins and 7 wt % aromatics. The amount of VI improver was adjusted to 15 wt % to keep the ISO VG 28 grade. The same additives as those included in Neste Hydrauli Arctic 28 were added. The composition of the invention was as follows:

| | |
|---|---|
| NBO component of Neste Hydrauli Arctic 28 | 55.5 wt % |
| IPO X | 20 wt % |
| VI improver (Viscoplex 7-200) | 22 wt % |
| Additives | 2.5 wt % |

The kinematic viscosity of the composition of the present invention and that of the above commercial hydraulic fluid as a reference were measured according to ENISO3104 at various temperatures. The results are shown in Table 4.

TABLE 4

| | Temperature (° C.) | Neste Hydrauli Arctic 28 | Composition of the invention, ISO VG 28 |
|---|---|---|---|
| Kinematic viscosity ($mm^2/s$) | −50 | 18420 | n.d. |
| | −40 | 4167 | 1952 |
| | −30 | 1384 | 746 |
| | −20 | 580 | 362 |
| | −10 | 284 | 198 |
| | 0 | 159 | 120 |
| | 20 | 64 | 54 |
| | 40 | 33 | 30 |
| | 100 | 9.6 | 9.2 |

n.d. = not detectible

The results show that the absolute viscosity level of below 1000 $mm^2/s$ was achieved at −30° C. in the composition of the invention whereas 1000 $mm^2/s$ was exceeded with the reference formulation. Also at −40° C. the viscosity level was substantially decreased with the composition of the invention compared with that of the reference. At −50° C., the viscosity could not be determined since it was close to the pour point (−51° C.) and the composition turned turbid. Similarly, the viscosity of the reference formulation was beyond the level of good operability. It can be concluded that the operability was improved with the composition of the invention down to −40° C.

Flash point, pour point and viscosity index of the composition of the present invention and the reference are shown in Table 5.

TABLE 5

| Property | Method | Neste Hydrauli Arctic 28 | Composition of the invention, ISO VG 28 |
|---|---|---|---|
| Flash point (° C.) | ENISO2592 | 126 | 130 |
| Pour point (° C.) | ASTMD5950 | −60 | −51 |
| Viscosity index | ASTMD2270 | 294 | >300 |

The flash point of the composition of the invention was at an acceptable level. Pour point was increased by 9° C. from that of the reference. Again, the viscosity index is a better indication for a proper cold temperature operability than the pour point. The operability was improved with the composition of the invention down to −40° C. The viscosity index was improved compared with the reference.

EXAMPLE 4

A shock absorber fluid of the invention was prepared by combining IPO X described in Example 1 together with a fossil base oil BO X. A reference formulation containing fossil base oil components BO X and BO Y was prepared.

BO X is a higher viscosity group III fossil base oil containing naphthenes in amount of about 58 wt %. The kinematic viscosity of BO X was 12.1 $mm^2/s$ at 40° C., and 3.0 $mm^2/s$ at 100° C. The pour point of BO X was −24° C.

BO Y is a fossil base oil containing naphthenes and having a kinematic viscosity of 2.9 $mm^2/s$ at 40° C., and 1.2 $mm^2/s$ at 100° C. The pour point of BO Y was −40° C.

Table 6 shows the composition and physical properties of the shock absorber fluid of the present invention and those of the reference formulation. The kinematic viscosity (KV) was measured according to ASTMD445. The pour point was measured according to ASTMD5950.

TABLE 6

| Component | Reference shock absorber fluid | Composition of the invention |
|---|---|---|
| | Amount in the composition [wt %] | |
| Composition | | |
| BO X | 42.5 | 51 |
| BO Y | 47.5 | |
| IPO X | | 40 |
| VI improver, (Viscoplex 7-200) | 10 | 10 |
| Physical properties | | |
| KV 100° C. [$mm^2/s$] | 4.2 | 4.2 |
| KV 40° C. [$mm^2/s$] | 12.0 | 12.0 |
| KV 20° C. [$mm^2/s$] | 20.8 | 20.8 |

TABLE 6-continued

| Component | Reference shock absorber fluid Amount in the composition [wt %] | Composition of the invention |
|---|---|---|
| VI | >300 | >300 |
| Brookfield viscosity −40° C. | 600 | 500 |
| Pour point [° C.] | −57 | −51 |
| Flash point [° C.] ASTMD92 | 144 | 156 |

The results show that a shock absorber fluid meeting the requirements for the KV40 (12-13 $mm^2/s$), KV100 (min 4 $mm^2/s$) pour point (<−45° C.), and flash point (min. 115° C.) in shock absorber fluids could be formulated containing the hydrocarbon component of the present invention. The viscosity behavior at low temperatures as verified by Brookfield viscosity test at −40° C. measured according to DIN 51398 showed the same improved behavior as in the previous examples.

It will be obvious to a person skilled in the art that, as the technology advances, the inventive concept can be implemented in various ways. The invention and its embodiments are not limited to the examples described above but may vary within the scope of the claims.

The invention claimed is:

1. A hydraulic fluid composition comprising:

a hydrocarbon component containing more than 5 wt % of naphthenic oil and from about 20 wt % to 95 wt % of renewable or recycled isoparaffinic oil, based on a total weight of the composition, and wherein the renewable or recycled isoparaffinic oil has <C15 paraffins and isoparaffins less than about 5 wt % and >C18 paraffins and isoparaffins less than about 5 wt %.

2. The hydraulic fluid composition of claim 1, wherein the hydrocarbon component consists of the isoparaffinic oil and the naphthenic oil.

3. The hydraulic fluid composition of claim 1, wherein an amount of the naphthenic oil is selected to be less than 80% wt %, specifically less than 70 wt %, based on a total weight of the composition.

4. The hydraulic fluid composition of claim 1, wherein the hydraulic fluid composition comprises:

from about 20 wt % to about 30 wt % of the renewable or recycled isoparaffinic oil, based on a total weight of the composition.

5. The hydraulic fluid composition of claim 1, wherein the renewable or recycled isoparaffinic oil is selected to have a distillation range of 240-300° C., specifically from 267° C. to 288° C., or from 283° C. to 300° C., or from 265° C. to 290° C.

6. The hydraulic fluid composition of claim 5, wherein the isoparaffinic oil has a distillation range from 267° C. to 288° C. and has one or more of the following carbon chain distributions:

C15 paraffins from about 5 wt % to about 15 wt % of which isoparaffins more than about 75 wt %, C16 paraffins from about 50 wt % to about 65 wt % of which isoparaffins more than about 90 wt %, C17 paraffins from about 20 wt % to about 30 wt % of which isoparaffins more than 90 wt %, C18 paraffins from about 5 wt % to about 15 wt % of which isoparaffins more than about 90 wt %.

7. The hydraulic fluid composition of claim 6, wherein the isoparaffinic oil has the following carbon chain distributions:

<C15 paraffins 1.02 wt %,

C15 paraffins 7.86 wt % of which isoparaffins 79.81 wt %,

C16 paraffins 58.83 wt % of which isoparaffins 94.33 wt %,

C17 paraffins 23.82 wt % of which isoparaffins 97.03 wt %, or

C18 paraffins 8.48 wt % of which isoparaffins 99.96 wt %, or

>C18 paraffins 0.00 wt %.

8. The hydraulic fluid composition of claim 6, wherein a pour point of the isoparaffinic oil is −69° C. measured according to ASTMD 5950.

9. The hydraulic fluid composition of claim 5, wherein the isoparaffinic oil has a distillation range from 283° C. to 300° C. and has one or more of the following carbon chain distributions:

<C16 paraffins and isoparaffins less than about 5 wt %,

C16 paraffins from 0 wt % to about 10 wt % of which isoparaffins more than 80 wt %, C17 paraffins from about 5 wt % to about 20 wt % of which isoparaffins more than about 50 wt %, C18 paraffins from about 70 wt % to about 85 wt % of which isoparaffins more than 90 wt %, C19 paraffins less than about 5 wt % of which isoparaffins more than about 90 wt %, or C20 paraffins and isoparaffins less than about 5 wt % of which isoparaffins more than about 90 wt %.

10. The hydraulic fluid composition of claim 9, wherein the isoparaffinic oil has the following carbon chain distributions:

<C16 paraffins 0.18 wt %,

C16 paraffins 2.02 wt % of which isoparaffins 87.13 wt %,

C17 paraffins 12.44 wt % of which isoparaffins 58.41 wt %,

C18 paraffins 81.91 wt % of which isoparaffins 96.82 wt %,

C19 paraffins 1.30 wt % of which isoparaffins 97.35 wt %,

C20 paraffins 1.14 wt % of which isoparaffins 97.90 wt %, or

>C20 paraffins 1.01 wt %.

11. The hydraulic fluid composition of claim 9, wherein a pour point of the isoparaffinic oil is −42° C. measured according to ASTMD 5950.

12. The hydraulic fluid composition of claim 1, comprising:

one or more viscosity index improvers in an amount of 0.01 wt % to 30 wt %, specifically 5 wt % to 15 wt %, based on a total weight of the composition.

13. The hydraulic fluid composition of claim 1, comprising:

one or more additives up to 5 wt % based on a total weight of the composition.

14. The hydraulic fluid composition of claim 1, wherein a kinematic viscosity of the composition is selected to be below 5000 cSt at −30° C., specifically below 1000 cSt at −30° C., measured according to ENISO3104.

15. The hydraulic fluid composition of claim 1, wherein a viscosity index of the composition is selected to be in a range of 50-1000, specifically 250-1000, measured according to ASTMD2270.

16. The hydraulic fluid composition of claim 1, wherein a flash point of the composition is above 100° C. measured according to ENISO2592 or ASTMD92.

17. The hydraulic fluid composition of claim 1, wherein the fluid composition is selected from an artic hydraulic fluid composition, a shock absorber fluid composition and an automatic transmission fluid composition.

18. The hydraulic fluid composition of claim 2, wherein an amount of the naphthenic oil is selected to be less than 80% wt %, specifically less than 70 wt %, based on a total weight of the composition.

19. The hydraulic fluid composition of claim 2, wherein the hydraulic fluid composition comprises:

from about 20 wt % to about 30 wt % of the renewable or recycled isoparaffinic oil, based on a total weight of the composition.

* * * * *